US011480929B2

(12) United States Patent
Wright

(10) Patent No.: US 11,480,929 B2
(45) Date of Patent: Oct. 25, 2022

(54) AUDIBLE WRIST WATCH ASSEMBLY

(71) Applicant: Robbie Wright, Manor, TX (US)

(72) Inventor: Robbie Wright, Manor, TX (US)

( * ) Notice: Subject to any disclaimer, the term of this patent is extended or adjusted under 35 U.S.C. 154(b) by 429 days.

(21) Appl. No.: 16/688,785

(22) Filed: Nov. 19, 2019

(65) Prior Publication Data

US 2021/0149346 A1 May 20, 2021

(51) Int. Cl.
*G04G 13/02* (2006.01)
*G04C 21/14* (2006.01)
*G04G 9/00* (2006.01)

(52) U.S. Cl.
CPC ..... *G04G 13/026* (2013.01); *G04C 21/14* (2013.01); *G04G 9/0005* (2013.01); *G04G 13/021* (2013.01)

(58) Field of Classification Search
CPC .. G04G 13/026; G04G 9/0005; G04G 13/021; G04C 21/14
USPC ..... 368/250
See application file for complete search history.

(56) References Cited

U.S. PATENT DOCUMENTS 2,644,294 A 7/1953 Ditisheim
4,444,515 A * 4/1984 Clark ..... G04G 21/08 968/968
5,959,527 A * 9/1999 Beder ..... G04B 21/08 340/392.4
6,307,813 B1 * 10/2001 Leggio ..... G04G 9/00 368/63
D504,329 S 4/2005 Luscher
7,280,440 B2 10/2007 Goeller
8,111,589 B2 * 2/2012 Vidal ..... G04G 9/06 368/242
8,634,278 B1 * 1/2014 Nguyen ..... G04C 21/14 434/304
8,787,122 B2 * 7/2014 Bongio ..... G04C 21/12 368/230
8,824,245 B2 9/2014 Lau
11,209,782 B2 * 12/2021 Jones ..... G04G 21/06
2014/0192626 A1 * 7/2014 Wolff ..... G04C 21/14 368/185

FOREIGN PATENT DOCUMENTS

WO WO2012061136 5/2012

* cited by examiner

*Primary Examiner* — Kerri L Mcnally

(57) ABSTRACT

An audible wrist watch assembly includes a wrist watch that is wearable on a user's wrist. An audio unit is coupled to the wrist watch and the audio unit emits a plurality of time alerts. The audio unit emits each of the time alerts upon the respective hour of the day to audibly communicate the hour of the day to a visually impaired user. A reminder unit is coupled to the wrist watch and the reminder unit stores a plurality of verbal reminders. Each of the verbal reminders is programmable to correspond to a respective hour of the day. Moreover, the reminder unit audibly emits each of the verbal reminders at the respective hour of the day to remind the user to perform a task at a certain time.

3 Claims, 5 Drawing Sheets

AUDIBLE WRIST WATCH ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to wrist watch devices and more particularly pertains to a new wrist watch device for audibly communicating the time of day to a user.

(2) Description of Related Art Including Information Disclosed Under 37 CFR 1.97 and 1.98

The prior art relates to wrist watch devices.

BRIEF SUMMARY OF THE INVENTION

An embodiment of the disclosure meets the needs presented above by generally comprising a wrist watch that is wearable on a user's wrist. An audio unit is coupled to the wrist watch and the audio unit emits a plurality of time alerts. The audio unit emits each of the time alerts upon the respective hour of the day to audibly communicate the hour of the day to a visually impaired user. A reminder unit is coupled to the wrist watch and the reminder unit stores a plurality of verbal reminders. Each of the verbal reminders is programmable to correspond to a respective hour of the day. Moreover, the reminder unit audibly emits each of the verbal reminders at the respective hour of the day to remind the user to perform a task at a certain time.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
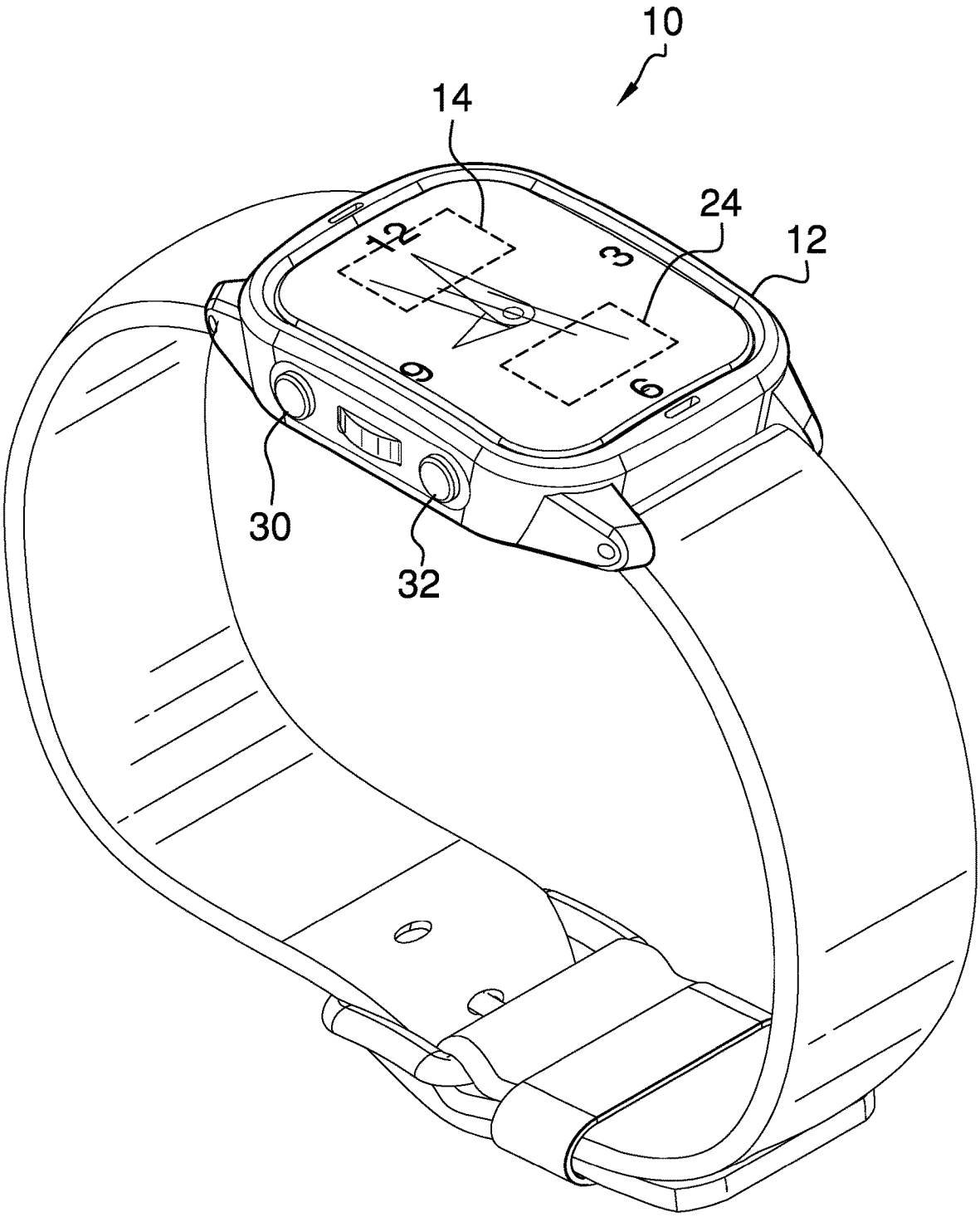
FIG. 1 is a perspective phantom view of an audible wrist watch assembly according to an embodiment of the disclosure.
Figure 2:
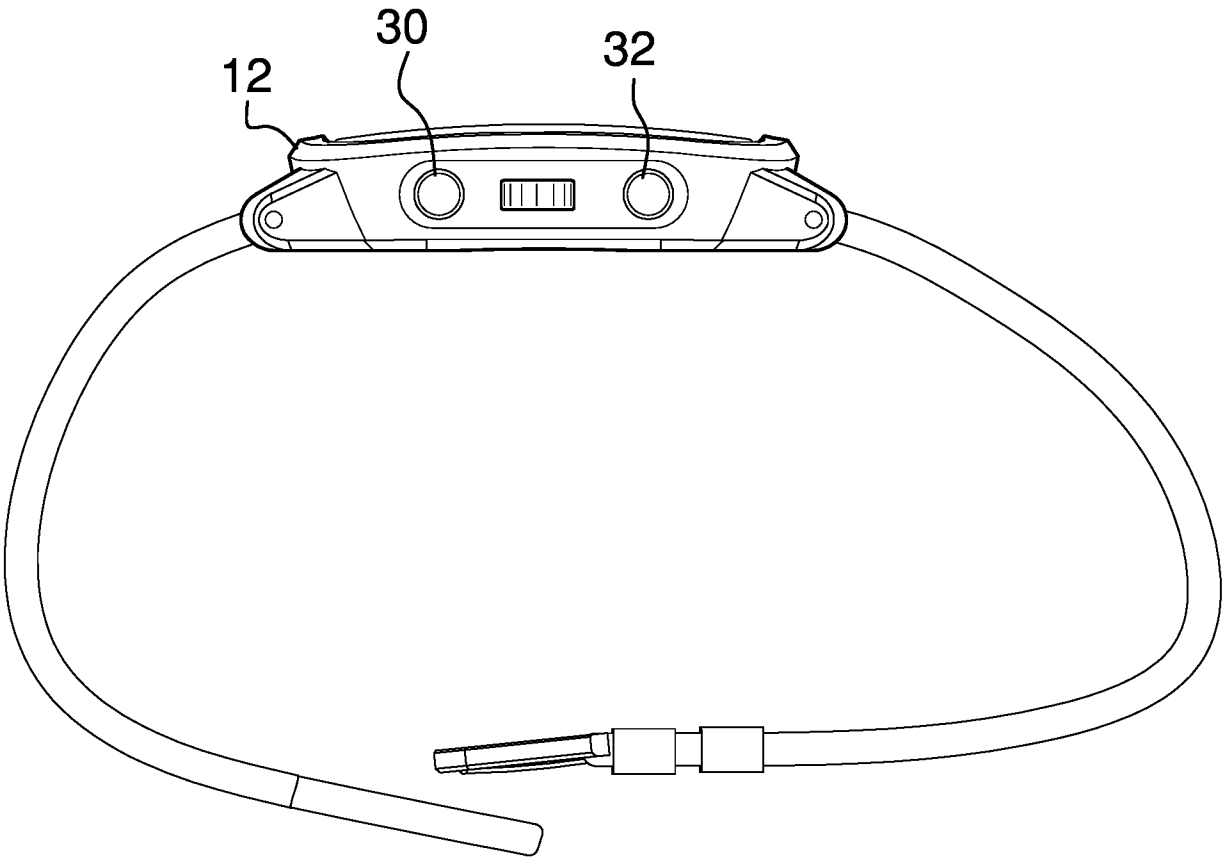
FIG. 2 is a right side view of an embodiment of the disclosure.
Figure 3:
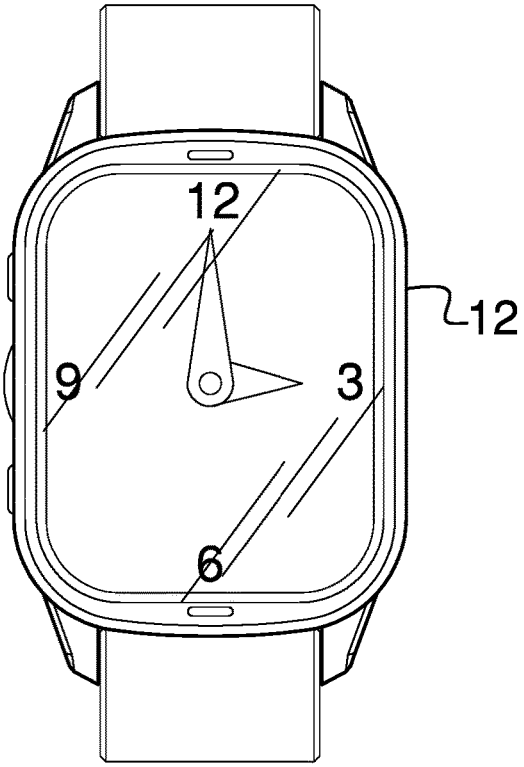
FIG. 3 is a top view of an embodiment of the disclosure.
Figure 4:
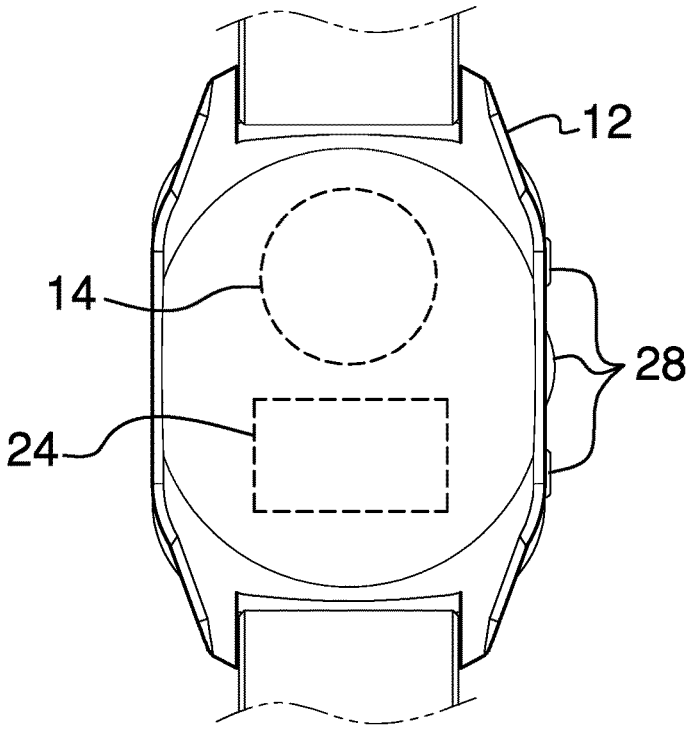
FIG. 4 is a bottom phantom view of an embodiment of the disclosure.
Figure 5:
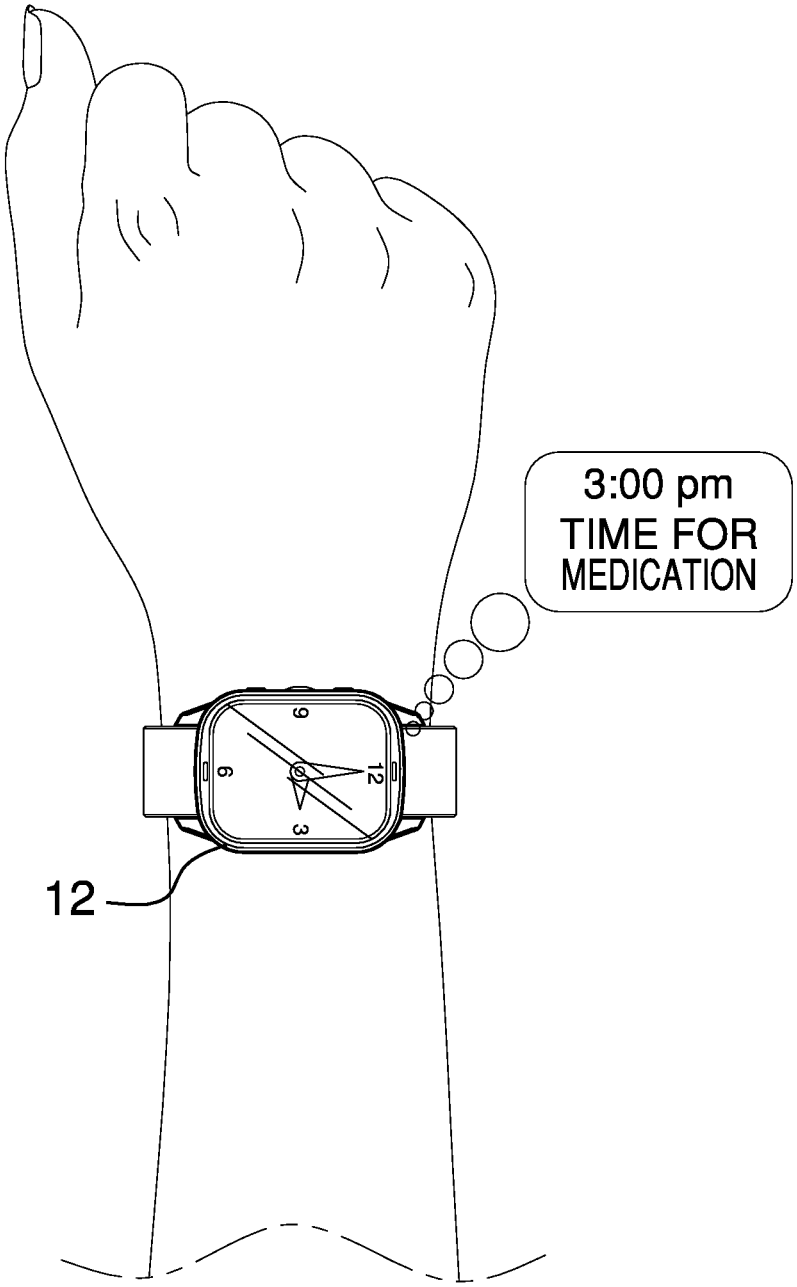
FIG. 5 is a perspective in-use view of an embodiment of the disclosure.
Figure 6:
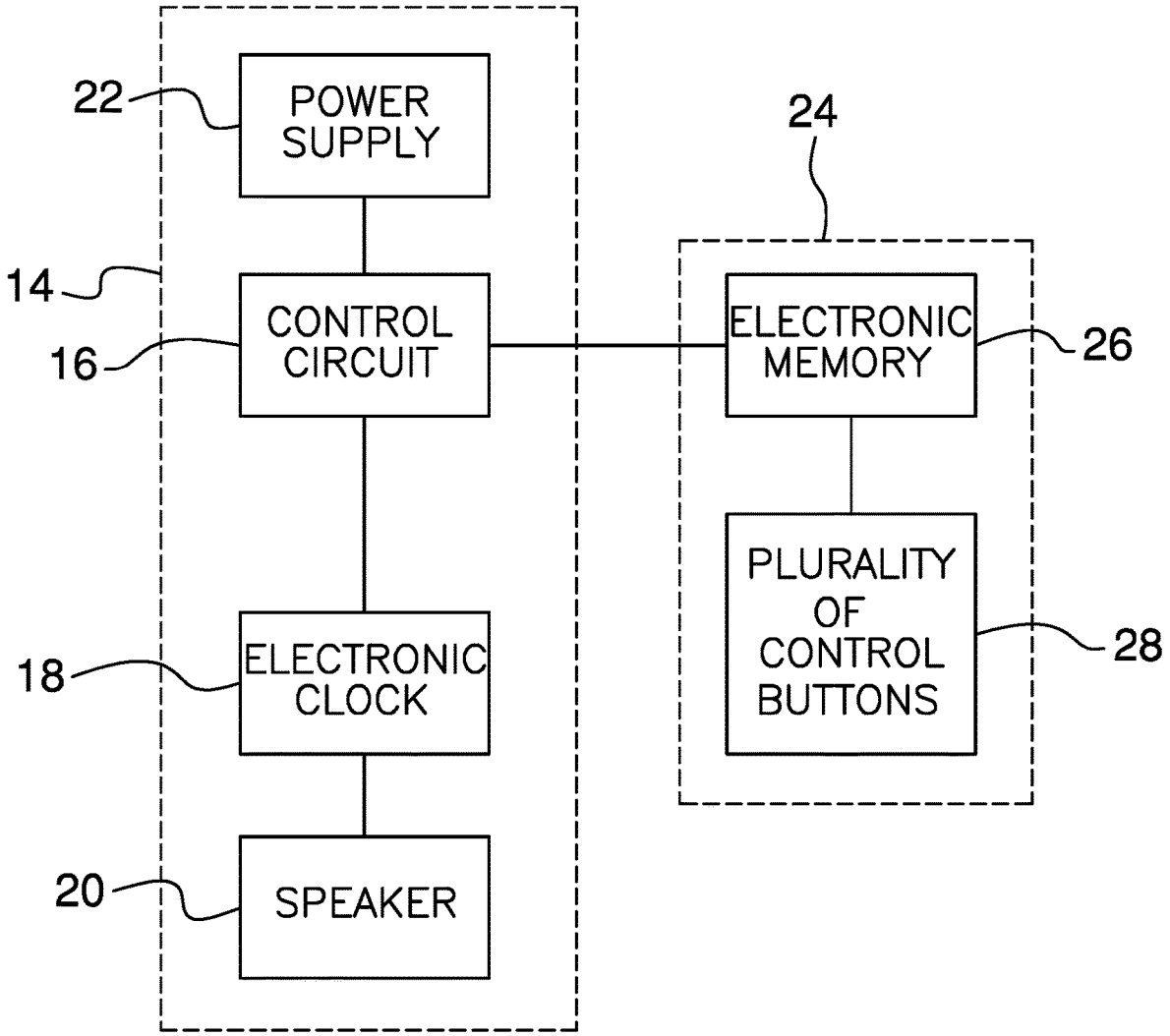
FIG. 6 is a schematic view of an embodiment of the disclosure.

With reference now to the drawings, and in particular to FIGS. 1 through 6 thereof, a new wrist watch device embodying the principles and concepts of an embodiment of the disclosure and generally designated by the reference numeral 10 will be described.

As best illustrated in FIGS. 1 through 6, the audible wrist watch assembly 10 generally comprises a wrist watch 12 that is wearable on a user's wrist. An audio unit 14 is provided and the audio unit 14 is coupled to the wrist watch 12. The audio unit 14 emits a plurality of time alerts and each of the time alerts is associated with a respective hour of the day. The audio unit 14 emits each of the timer alerts upon the respective hour of the day. Each of the time alerts comprises a sequence of chimes. The sequence of chimes associated with each of the time alerts corresponds to the numerical value of the respective hour of the day. In this way the audio unit 14 can audibly communicate the hour of the day to a visually impaired user.

The audio unit 14 comprises a control circuit 16 that is coupled to the wrist watch 12. The control circuit 16 receives a plurality of time inputs and a reminder input. Additionally, each of the time inputs is assigned to a respective hour of the day. The audio unit 14 includes an electronic clock 18 that is coupled to the wrist watch 12. The electronic clock 18 is electrically coupled to the control circuit 16 and the electronic clock 18 tracks the hour of the day. The control circuit 16 receives each of the time inputs at the beginning of the respective hour of the day.

The audio unit 14 includes a speaker 20 that is coupled to the wrist watch 12 to emit an audible sound outwardly therefrom when the speaker 20 is turned on. The speaker 20 is electrically coupled to the control circuit 16. The speaker 20 emits a sequence of chimes that correspond to the numerical value of the respective hour of the day when the control circuit 16 receives the time input assigned to the respective hour of the day. In this way the speaker 20 audibly communicates the hour of the day to the user at the top of each hour. The audio unit 14 includes a power supply 22 that is coupled to the wrist watch 12. The power supply 22 is electrically coupled to the control circuit 16 and the power supply 22 comprises at least one battery.

A reminder unit 24 is coupled to the wrist watch 12 and the reminder unit 24 stores a plurality of verbal reminders. Each of the verbal reminders is programmable to correspond to a respective hour of the day. The reminder unit 24 audibly emits each of the verbal reminders at the respective hour of the day. In this way the reminder unit 24 can remind the user to perform a task at a certain time.

The reminder unit 24 comprises an electronic memory 26 that is coupled to the wrist watch 12. The electronic memory 26 is electrically coupled to the control circuit 16 and the electronic memory 26 stores a database comprising a plurality of verbal reminders. The electronic memory 26 may comprise RAM or other type of electronic data storage. The plurality of verbal reminders may include, but not be limited to, a reminder to take medication, a reminder to perform a task that should be performed on a repetitive basis or any other useful reminder.

The reminder unit 24 includes a plurality of control buttons 28 that is each movably coupled to the wrist watch 12. Each of the control buttons 28 is electrically coupled to the control circuit 16. The plurality of control buttons 28 may include, but not be limited to, a select button 30 and a program button 32. The select button 30 actuates a selected one of the verbal reminders stored in the electronic memory 26. The program button 32 assigns the selected verbal reminder to a respective hour of the day.

The speaker 20 emits the selected verbal reminder at the respective hour of the day for reminding the user to perform the task associated with the selected verbal reminder. The reminder unit 24 may include a data port that is recessed into the wrist watch 12 and the data port may be electrically coupled to the control circuit 16. The data port may be electrically coupled to an external data storage device, such as a personal computer or the like, for downloading customized verbal reminders into the electronic memory 26.

In use, the wrist watch 12 is worn in the convention means of wearing a wrist watch 12. The speaker 20 emits the sequence of chimes at the top of each hour of the day to audible inform the user of the time of day. In this way a visually impaired user can be alerted to each hour of the day. The control buttons 28 are manipulated to select the verbal reminders and to assign the selected verbal reminders to respective hours of the day. Thus, the speaker 20 emits the verbal reminder at the assigned hour of the day to remind the user to perform various tasks at assigned hours of the day.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An audible wrist watch assembly being configured to emit an audible alert on the hour to facilitate a vision impaired user to know the time of day, said assembly comprising:

a wrist watch being wearable on a user's wrist;

an audio unit being coupled to said wrist watch, said audio unit emitting a plurality of time alerts, each of said time alerts being associated with a respective hour of the day, said audio unit emitting each of said time alerts upon the respective hour of the day, each of said time alerts comprising a sequence of chimes, said sequence of chimes associated with each of said time alerts corresponding to the numerical value of the respective hour of the day wherein said audio unit is configured to audibly communicate the hour of the day to a visually impaired user, wherein said audio unit comprises a control circuit being coupled to said wrist watch, said control circuit receiving a plurality of time inputs and a reminder input, each of said time inputs being assigned to a respective hour of the day, an electronic clock being coupled to said wrist watch, said electronic clock being electrically coupled to said control circuit, said electronic clock tracking the hour of the day, said control circuit receiving each of said time inputs at the beginning of the respective hour of the day, a speaker being coupled to said wrist watch to emit an audible sound outwardly therefrom when said speaker is turned on, said speaker being electrically coupled to said control circuit, said speaker emitting a sequence of chimes that correspond to the numerical value of the respective hour of the day when said control circuit receives said time input assigned to the respective hour of the day; and a reminder unit being coupled to said wrist watch, said reminder unit storing a plurality of verbal reminders, each of said verbal reminders being programmable to correspond to a respective hour of the day, said reminder unit audibly emitting each of said verbal reminders at the respective hour of the day wherein said reminder unit is configured to remind the user to perform a task at a certain time, wherein said reminder unit comprises an electronic memory being coupled to said wrist watch, said electronic memory being electrically coupled to said control circuit, said electronic memory storing a database comprising a plurality of verbal reminders, and a plurality of control buttons, each of said control buttons being movably coupled to said wrist watch, each of said control buttons being electrically coupled to said control circuit, wherein said plurality of control buttons includes a select button and a program button, said select button actuating a selected one of said verbal reminders stored in said electronic memory, said program button assigning said selected verbal reminder to a respective hour of the day, said speaker emitting said selected verbal reminder at the respective hour of the day for reminding the user to perform the task associated with said selected verbal reminder.

2. The assembly according to claim 1, wherein said audio unit includes a power supply being coupled to said wrist watch, said power supply being electrically coupled to said control circuit.

3. An audible wrist watch assembly being configured to emit an audible alert on the hour to facilitate a vision impaired user to know the time of day, said assembly comprising:

a wrist watch being wearable on a user's wrist;

a audio unit being coupled to said wrist watch, said audio unit emitting a plurality of time alerts, each of said time alerts being associated with a respective hour of the day, said audio unit emitting each of said time alerts upon the respective hour of the day, each of said time alerts comprising a sequence of chimes, said sequence of chimes associated with each of said time alerts corresponding to the numerical value of the respective hour of the day wherein said audio unit is configured to audibly communicate the hour of the day to a visually impaired user, said audio unit comprising:

a control circuit being coupled to said wrist watch, said control circuit receiving a plurality of time inputs and a reminder input, each of said time inputs being assigned to a respective hour of the day;

an electronic clock being coupled to said wrist watch, said electronic clock being electrically coupled to said control circuit, said electronic clock tracking the hour of the day, said control circuit receiving each of said time inputs at the beginning of the respective hour of the day;

a speaker being coupled to said wrist watch to emit an audible sound outwardly therefrom when said speaker is turned on, said speaker being electrically coupled to said control circuit, said speaker emitting a sequence of chimes that correspond to the numerical value of the respective hour of the day when said control circuit receives said time input assigned to the respective hour of the day; and a power supply being coupled to said wrist watch, said power supply being electrically coupled to said control circuit, said power supply comprising at least one battery; and a reminder unit being coupled to said wrist watch, said reminder unit storing a plurality of verbal reminders, each of said verbal reminders being programmable to correspond to a respective hour of the day, said reminder unit audibly emitting each of said verbal reminders at the respective hour of the day wherein said reminder unit is configured to remind the user to perform a task at a certain time, said reminder unit comprising:

an electronic memory being coupled to said wrist watch, said electronic memory being electrically coupled to said control circuit, said electronic memory storing a database comprising a plurality of verbal reminders; and a plurality of control buttons, each of said control buttons being movably coupled to said wrist watch, each of said control buttons being electrically coupled to said control circuit, said plurality of control buttons including a select button and a program button, said select button actuating a selected one of said verbal reminders stored in said electronic memory, said program button assigning said selected verbal reminder to a respective hour of the day, said speaker emitting said selected verbal reminder at the respective hour of the day for reminding the user to perform the task associated with said selected verbal reminder.

* * * * *